United States Patent [19]

Yumura et al.

[11] Patent Number: 4,910,486

[45] Date of Patent: Mar. 20, 1990

[54] ELECTROMAGNETIC DRIVE ACTUATOR

[75] Inventors: Takashi Yumura; Tetsu Yamamoto; Manabu Ogura, all of Hyogo, Japan

[73] Assignee: Mitsubishi Denki Kabushiki Kaisha, Tokyo, Japan

[21] Appl. No.: 359,815

[22] Filed: Jun. 1, 1989

[51] Int. Cl.[4] ..... H01F 7/08

[52] U.S. Cl. ..... 335/222; 335/223

[58] Field of Search ..... 335/222, 223, 224, 226, 335/229, 230, 231

[56] References Cited

U.S. PATENT DOCUMENTS

| | | | |
|---|---|---|---|
| 3,161,793 | 12/1964 | Laithwaite | 335/222 X |
| 4,048,602 | 9/1977 | Diamantides | 335/222 |
| 4,703,297 | 10/1987 | Nagasaka | 335/222 |
| 4,808,955 | 2/1989 | Godkin et al. | 335/222 |

FOREIGN PATENT DOCUMENTS 58-63881 4/1983 Japan .

*Primary Examiner*—George Harris

*Attorney, Agent, or Firm*—Sughrue, Mion, Zinn, Macpeak & Seas

[57] ABSTRACT

An electromagnetic drive actuator including a magnetic circuit comprising at least one yoke having plate-shaped, L-shaped, E-shaped cross section or the like, at least one magnet mounted on the yoke and a magnetic flux extending from the magnet to the yoke, at least one coil arranged so as to cross the magnetic flux and produce a drive force in a direction crossing a plane including the magnetic path of the magnetic circuit when current is applied to the coil, and at least one magnetic shield member provided at the side portion of the coil to thereby prevent a counter drive force from being produced in a direction opposite to a desired direction of a drive force produced by the coil.

15 Claims, 7 Drawing Sheets

ELECTROMAGNETIC DRIVE ACTUATOR

BACKGROUND OF THE INVENTION

This invention relates to an electromagnetic drive actuator.

FIG. 1 is a perspective view showing a conventional electromagnetic drive actuator as disclosed in Japanese Utility Model Application (OPI) No 63881/1983 (the term "OPI" as used herein means an "unexamined published application"), and FIG. 2 is an explanatory diagram for the operation thereof.

In these figures, reference numeral 1 designates permanent magnets for producing magnetic flux; 2, outer yokes; 3, a side yoke; 4, a center yoke; 5, gaps; and 6, a coil for providing a drive force when energized.

In the electromagnetic drive actuator thus constructed, the magnetic flux produced by the permanent magnet 1, as indicated by the broken lines in FIG. 2, passes through the air gap 5 while intersecting the coil 6 and through the center yoke 4, the side yoke 3 and the outer yoke 2 to return the permanent magnet 1, thus forming a closed magnetic path. Therefore, when current is applied to the coil 6, a drive force is provided in the direction of the arrow as indicated in FIG. 2. To make understanding of this invention clear, FIG. 2 shows only the magnetic flux formed on one side of the electromagnetic drive actuator.

The conventional electromagnetic drive actuator thus designed has a disadvantage that all the magnetic fluxes caused in the electromagnet 1 pass through the center yoke 4, the outer yokes 2 and the side yoke 3 to thereby make the magnetic flux density high, and therefore those yokes are required to be designed relatively large in cross section. This requirement is strong when the distance of movement of the coil 6 is increased.

In addition the conventional actuator has another disadvantage that it is unavoidably large in width, since the center yoke 4 is inserted into the coil 6.

SUMMARY OF THE INVENTION

An object of this invention is to eliminate the above-described difficulties accompanying a conventional electromagnetic drive actuator, and more particularly to provide an electromagnetic drive actuator which can be miniaturized.

An electromagnetic drive actuator according to this invention comprises: a magnetic circuit including at least one yoke, at least one magnet and magnetic flux extending from the magnet to the yoke; a coil arranged so as to cross the magnetic flux produced by the magnet and to produce, when current is applied to the coil, a drive force in a direction crossing a plane which includes the closed magnetic path of the magnetic circuit; and a magnetic shield member provided at the part or the side portion of the coil which produces a drive force in a direction opposite to the direction of a drive force produced by the coil.

PREFERRED EMBODIMENTS OF THE INVENTION

Preferred embodiments of this invention will be described with reference to the accompanying drawings.

Figure 4:
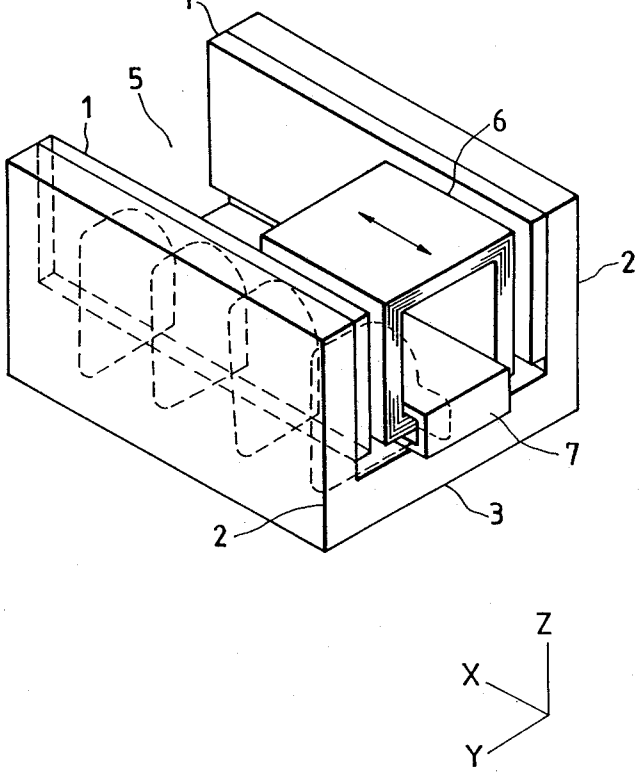
FIG. 4 is an explanatory diagram for the operation of the electromagnetic drive actuator as shown in FIG. 3.
Figure 3:
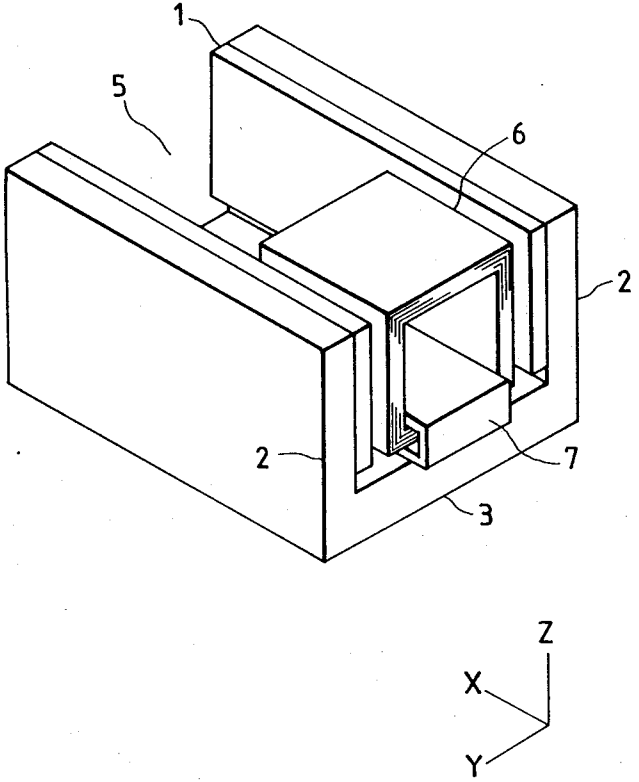
FIG. 3 is a perspective view showing a first embodiment of an electromagnetic drive actuator according to this invention.

FIG. 3 is a perspective view showing a first embodiment of an electromagnetic drive actuator according to the invention, and FIG. 4 is an explanatory diagram for the operation of the actuator. The actuator of the first embodiment comprises a yoke body having U-shaped cross section, permanent magnets 1 arranged on two confronted inner walls 2 of the yoke body, a coil 6 disposed between the permanent magnets 1, and a magnetic shield member 7 made of ferromagnetic material such as iron.

Figure 1:
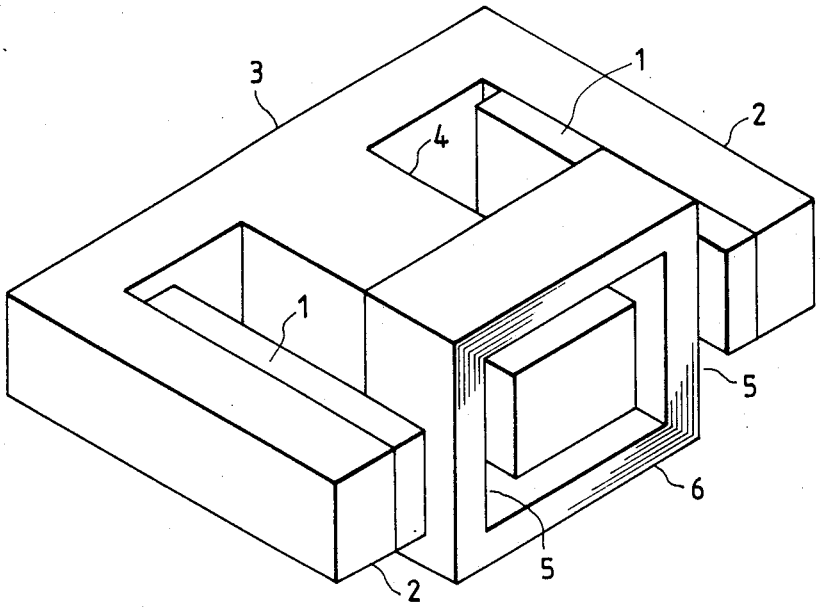
FIG. 1 PRIOR ART
FIG. 1 is a perspective view showing a conventional electromagnetic drive actuator.
Figure 2:
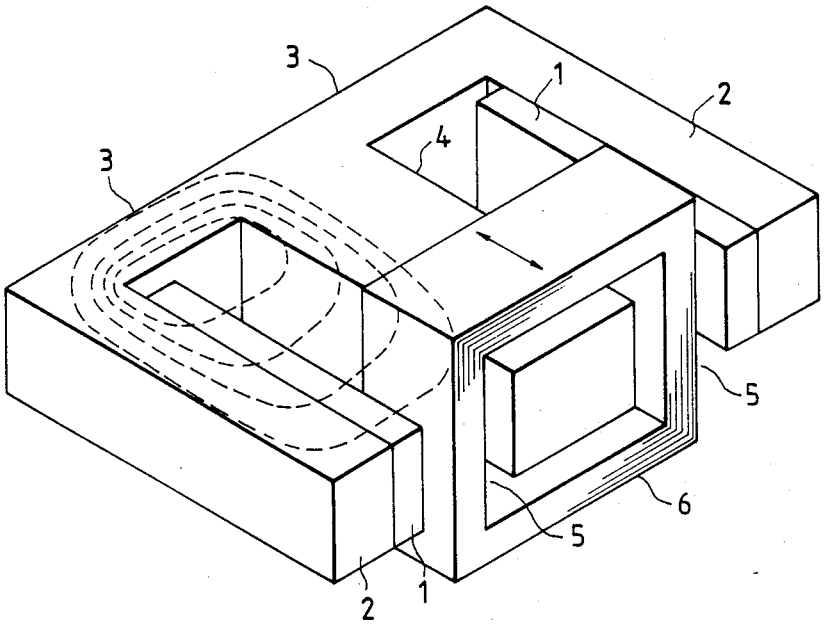
FIG. 2 PRIOR ART
FIG. 2 is an explanatory diagram for the operation of the conventional electromagnetic drive actuator.

In the electromagnetic drive actuator thus constructed, the magnetic flux formed by the permanent magnet 1, as indicated by the broken lines in FIG. 4, passes through the air gap 5 while crossing the coil 6 in a Z-X plane, and through the magnetic shield member 7 and the outer yoke 2, and returns to the permanent magnet, thus forming a closed magnetic path in a Y-Z plane. As a result, a drive force is produced in a direction crossing (perpendicularly in this case) the plane (X-Z) including the closed magnetic path of a magnetic circuit formed upon application of current to the coil 6; in other words, the drive force in induced along the X axis. In this case, the magnetic flux passing through the unitary area of the yokes 2 and 3 is only that which emits from the unitary area of the permanent magnet 1, and therefore the magnetic flux density is small irrespective of the distance of movement of the coil 6. Accordingly, in the electromagnetic drive actuator of this embodiment, the yoke can be smaller in size than in the conventional one as shown in FIGS. 1 and 2.

The magnetic shield member 7 is mounted on a part or a side portion of the coil 6 which produces a counter drive force in a direction opposite to the direction of the desired drive force, thereby preventing the magnetic flux from crossing the part of the coil and the counter drive force from being produced. FIG. 4 shows only the magnetic flux formed by one of the permanent magnets 1 for simplification.

In the above embodiment having an U-shaped yoke in cross section, two permanent magnets are provided on two confronted inner surfaces of the yoke. However, this embodiment is not limited to this arrangement, for example, at least one permanent magnet may be provided on at least one of three inner surfaces of the yoke.

FIGS. 5(A) through 5(E) are plan views showing modifications of the first embodiment of the electromagnetic drive actuator according to the invention. More specifically, each of FIGS. 5(A) through 5(E) is a plan view showing the positional relationships between the magnetic circuit and the coil in the electromagnetic drive actuator. The broken lines as shown in FIGS. 5(A) through 5(E) indicate magnetic flux.

Figure 5A:
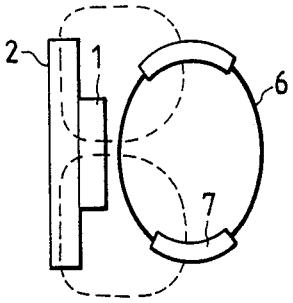
FIGS. 5(A) through 5(E) are plan views showing modifications of the first embodiment of the electromagnetic drive actuator according to the invention, each illustrating the positional relationship between a magnetic circuit and a coil.

The electromagnetic drive actuator as shown in FIG. 5(A) includes a permanent magnet 1 arranged on one major surface of a plate-shaped yoke 2 to form a magnetic circuit having magnetic paths as indicated by the broken lines, and a coil 6 so positioned as to cross the magnetic flux produced by the magnet 1.

Figure 5B:
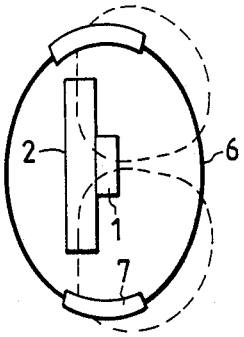

The electromagnetic drive actuator as shown in FIG. 5(B) includes a coil 6 arranged in such a manner as to surround the magnetic circuit which is formed similarly as in FIG. 5(A).

Figure 5C:
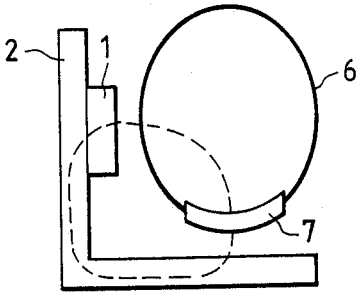

The electromagnetic drive actuator as shown in FIG. 5(C) includes a permanent magnet 1 arranged on one of the two inner walls of an L-shaped yoke 2 to form a magnetic circuit and a coil 6 so positioned as to confront the two inner walls of the yoke 2.

Figure 5D:
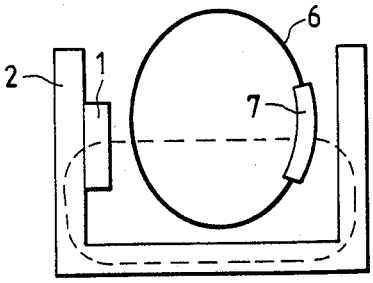
Figure 5E:
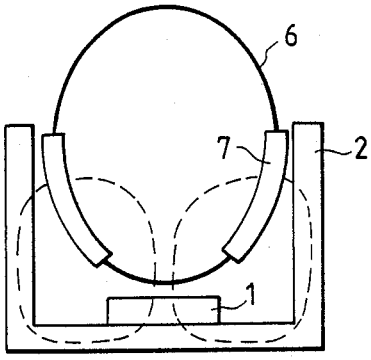

Each of the electromagnetic drive actuators as shown in FIGS. 5(D) and 5(E) includes a permanent magnet 1 arranged on one of the three inner walls of a U-shaped yoke 2 and a coil 6 so positioned as to confront the three inner walls of the yoke.

In each of the electromagnetic drive actuators as shown in FIGS. 5(A) through 5(E), the coil 6 is driven in a direction perpendicular to the plane including the closed magnetic paths of the magnetic circuit as indicated by the broken lines, and the same effect is obtained as in the actuator shown in FIGS. 3 and 4.

Figure 7:
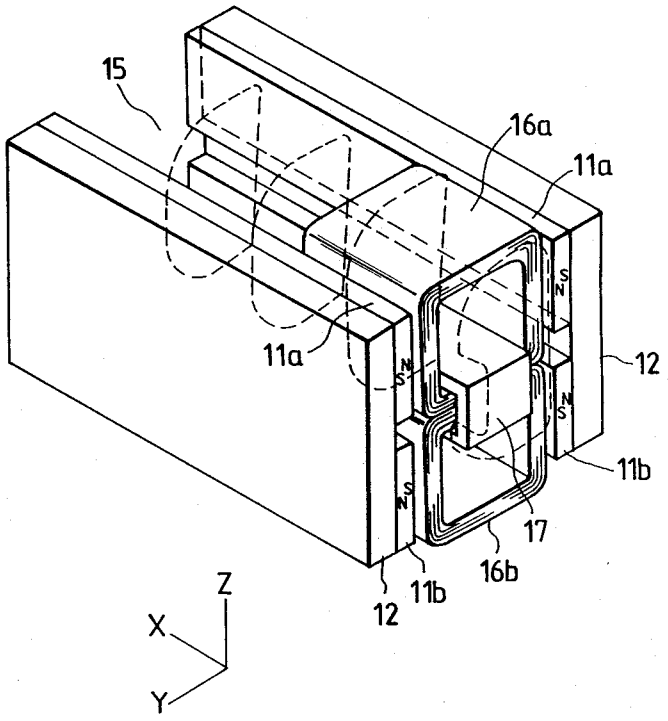
FIG. 7 is an explanatory diagram for explaining the operation of the electromagnetic drive actuator as shown in FIG. 6.
Figure 6:
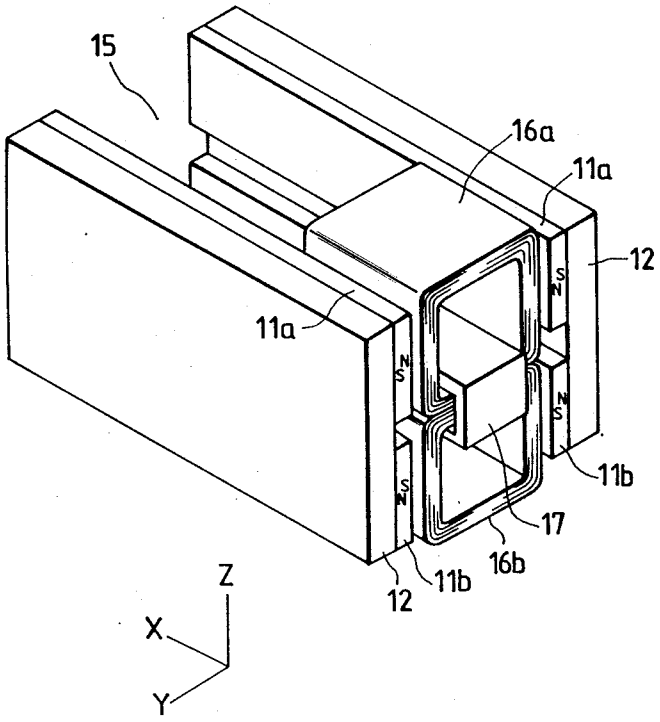
FIG. 6 is a perspective view showing a second embodiment of the electromagnetic drive actuator according to the invention.

FIG. 6 is a perspective view showing a second embodiment of the electromagnetic drive actuator according to the invention, and FIG. 7 is an explanatory diagram for the operation thereof.

In the electromagnetic drive actuator as shown in FIG. 6, two plate-shaped yokes 12 are disposed so as to be confronted with each other, and two permanent magnets 11*a* and 11*b* are arranged on one major surface of each of the yokes 12, and two coils 16*a* and 16*b* are positioned between the yokes 12 in such a manner that the coil 16*a* is interposed between the permanent magnets 11*a* and 11*a* while the coil 16*b* is interposed between the permanent magnets 11*b* and 11*b*. In FIG. 6, reference numeral 17 designates a magnetic shield member made of ferromagnetic material such as iron. The magnetic shield member 17 is mounted on the parts of the coils 16*a* and 16*b* which produce a drive force in a direction opposite to the direction of the desired drive force.

In the electromagnetic drive actuator thus constructed, as indicated by the broken lines in FIG. 7, the magnetic flux formed by the upper permanent magnet 11*a* passes through the air gap 15 while crossing the upper coil 16*a* in a Z-X plane, and passes through the magnetic shield member 17, and after crossing the lower coil 16*b* in a Z-X plane, enters the lower permanent magnet 11*b*, and returns through the yoke 12 to the upper permanent magnet 11*a*, thus forming a closed magnetic path in a Y-Z plane. Therefore, when current is applied to tee coils 16*a* and 16*b*, a drive force is produced in a direction crossing (perpendicularly in this case) the plate (X-Z) which includes the closed magnetic path of the magnetic circuit; that is, the drive force is induced along the X-axis. In the actuator, the magnetic flux passing through the unitary area of the yokes 12 is only that which emits from the unitary area of the permanent magnets 11*a* and 11*b*, so that the magnetic flux density is small irrespective of the distance of movement of the coils 16 and the yokes can be smaller in size than in the conventional one as shown in FIGS. 1 and 2. Furthermore, the magnetic shield member 17 is mounted on the parts of the coil 6 which produce a drive force in a direction opposite to the direction of the desired drive force, thereby preventing the magnetic flux from crossing the parts of the coils and the counter drive force from being produced.

In the electromagnetic drive actuator as shown in FIGS. 6 and 7, two magnetic circuits are arranged so as to be confronted with each other, so that each of the coils 16*a* and 16*b* has two drive-force generating planes. Furthermore, since two coils 16*a* and 16*b* are provided for the permanent magnets 11*a* and 11*b*, the higher drive force can be obtained.

Figure 8A:
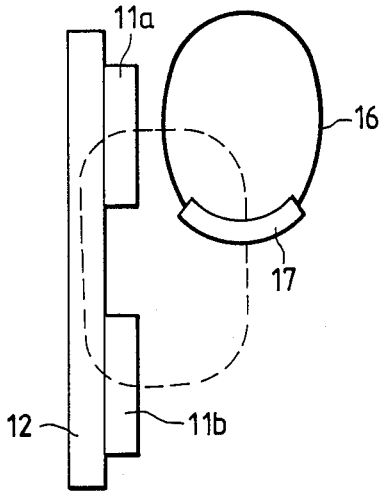
FIGS. 8(A), 8(B) and 8(C), are plan views showing modifications of the electromagnetic drive as shown in FIGS. 6 and 7 each illustrating the positional relationship between a magnetic circuit and a coil or coils.
Figure 8B:
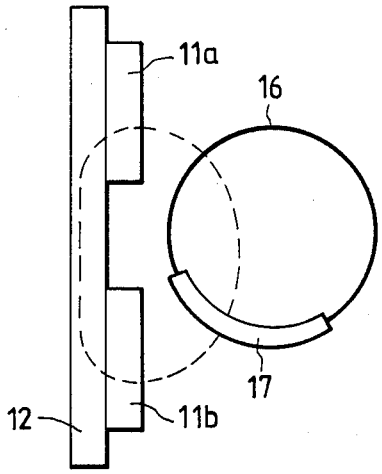
Figure 8C:
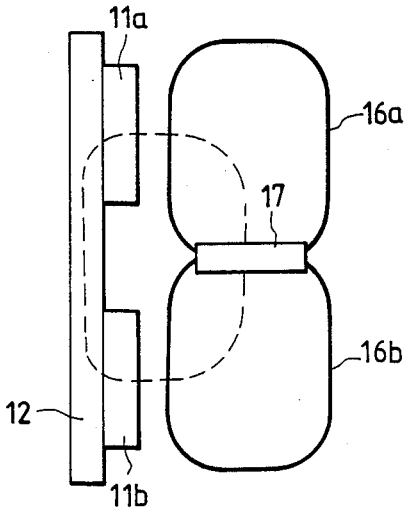

FIGS. 8(A) through 8(C) show modifications of the second embodiment of the electromagnetic drive actuator according to the invention, each showing the positional relationships between a magnetic circuit and a coil or coils in the electromagnetic drive actuator.

In the modification as shown in FIGS. 8(A) through (C), the coil 16 (16*a* and 16*b*) is driven in a direction perpendicular to the plane which includes the closed magnetic path of the magnetic circuit as indicated by the broken line. Thus, in the modifications, the same effect can be obtained as in the electromagnetic drive actuator as shown in FIGS. 6 and 7.

Figure 10:
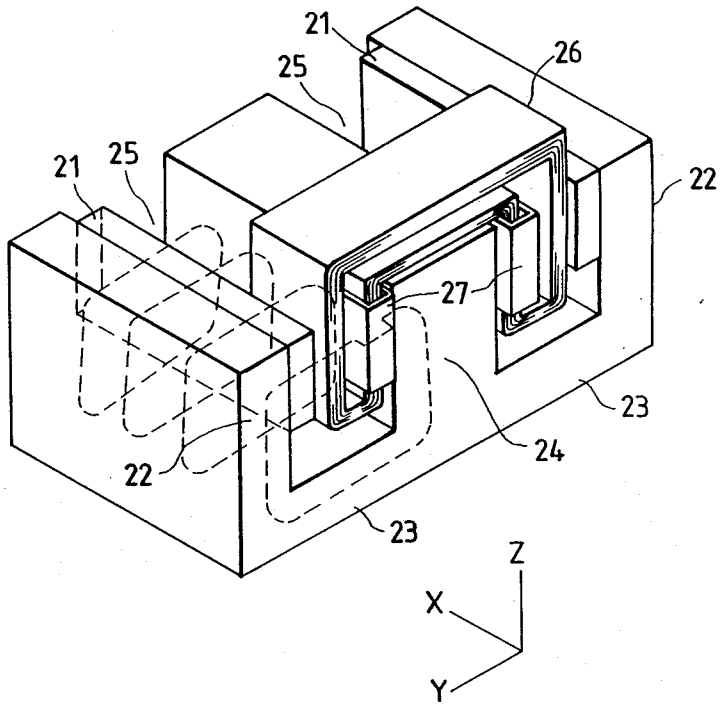
FIG. 10 is an explanatory diagram for the operation of the electromagnetic drive actuator as shown in FIG. 9.
Figure 9:
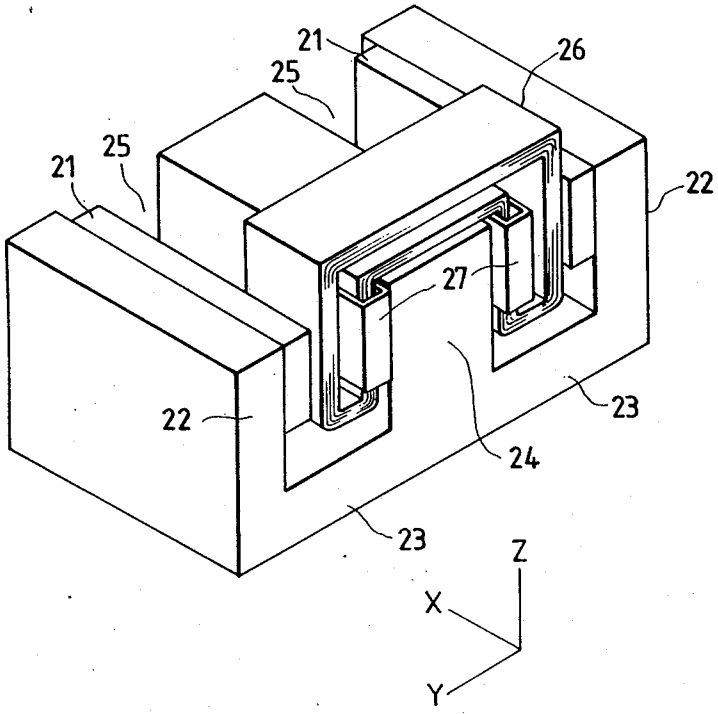
FIG. 9 is a perspective view showing a third embodiment of the electromagnetic drive actuator according to the invention.

FIG. 9 is a perspective view showing a third embodiment of the electromagnetic drive actuator according to the invention, and FIG. 10 is an explanatory diagram for the operation thereof.

The electromagnetic drive actuator as shown in FIG. 9 includes an E-shaped yoke comprising a center yoke 24, side yokes 22 and 22, and an outer yoke 23 connecting the center yoke and the side yokes, permanent magnets 21 secured to the inner walls of the side yokes 22 and 22 which confront the center yoke 24, a coil 26 inserted into two air gaps between the center yoke 24 and the two permanent magnets 21 in such a manner that it crosses the magnetic flux produced by the permanent magnet 21, and a magnetic shield member 27 made of ferromagnetic material such as iron.

In the electromagnetic drive actuator thus constructed, the magnetic flux produced by the permanent magnet 21, as shown in FIG. 10, passes through the air gap 25 while crossing the coil 26 in a Z-X plane, and after passing through the magnetic shield member 27, enters the center yoke 24, and then returns through the counter yoke 23 and the side yoke 22 to the permanent magnet 21, thus forming a closed magnetic path in a Y-Z plane. Therefore, when current is applied to the coil 26, a drive force is induced in a direction crossing (perpendicularly in this case) the plane (Y-Z) which includes the closed magnetic path of the magnetic circuit; that is, the drive force is formed along the X-axis.

In the actuator as shown in FIGS. 9 and 10, the magnetic flux passing through the unitary area of the yoke 22, 23 and 24 is only that which emits from the unitary area of the permanent magnet 21, so that the magnetic flux density is small irrespective of the distance of movement of the coil 26 and the yokes 22, 23 and 24 can be made smaller than in the conventional electromagnetic drive actuator as shown in FIGS. 1 and 2. The magnetic shield member 27 is mounted on the part of the coil which produces a drive force in a direction opposite to the desired direction, thus preventing the magnetic flux from crossing the part and the counter drive force from being produced. Only the magnetic flux produced by one of the permanent magnets 21 is shown in FIG. 10 for simplification.

Figure 11A:
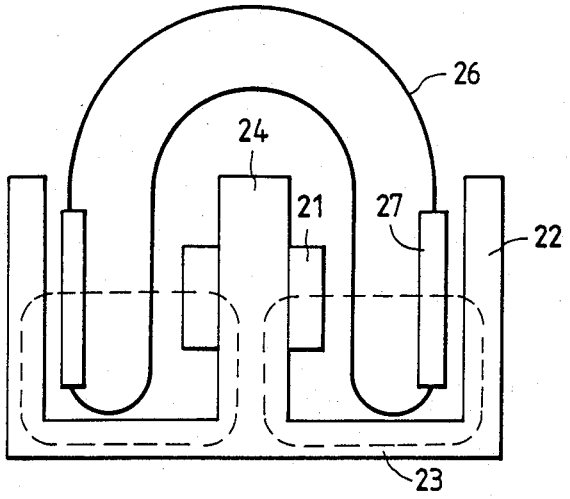
FIGS. 11(A) and 11(B) are plan view showing modifications of the electromagnetic drive actuator as shown in FIGS. 9 and 10, each illustrating the positional relationship between a magnetic circuit and a coil.
Figure 11B:
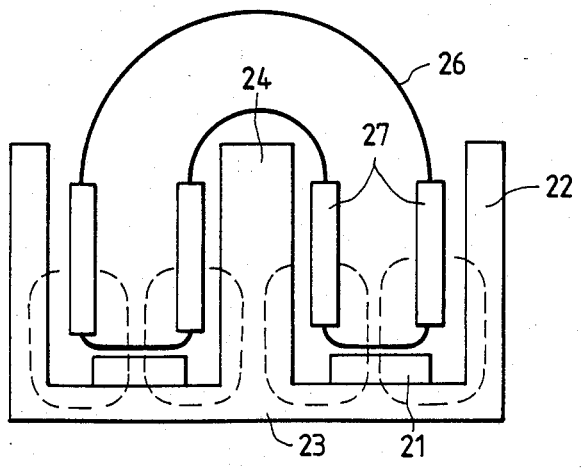

FIGS. 11(A) and 11(B) show modifications of the third embodiment of the electromagnetic drive actuator according to the invention, each showing the positional relationships between a magnetic circuit and a coil in the electromagnetic drive actuator. In these electromagnetic drive actuators, the coil 26 is driven in a direction perpendicular to the plane which includes the closed magnetic paths of the magnetic circuit as indicated by the broken line. Accordingly, the actuators have the same effect as that shown in FIGS. 9 and 10.

In each of the above-described electromagnetic drive actuators of the invention, the permanent magnets are employed. However, the technical concept of the invention may be equally applied to an electromagnetic drive_actuator having electromagnets with the same effects. Furthermore, in each of the above-described electromagnetic drive actuators according to the invention, the magnetic path is closed; however, the magnetic shield means can provide the same effect even if the magnetic path is half-opened, or opened.

As described above, according to this invention, the magnetic circuit forms the magnetic path in the plane which crosses the coil driving direction and the magnetic flux passing through the unitary area of the yoke is only that which emits from the unitary area of the magnet so that an actuator having a smaller yoke in size can be obtained. In addition, the provision of the magnetic shield member prevents the production of a drive force in a direction opposite to the desired direction.

What is claimed is:

1. An electromagnetic drive actuator comprising:

a magnetic circuit including at least one yoke, at least one magnet and magnetic flux extending from said magnet to said yoke;

at least one coil arranged so as to cross said magnetic flux and produce a drive force in a direction crossing a plane including the magnetic path of said magnetic circuit when current is applied to said coil; and at least one magnetic shield member provided at one side portion of said coil for preventing a counter drive force from being produced in an opposite direction to a desired direction of said drive force.

2. An electromagnetic drive actuator as claimed in claim 1, wherein said direction crossing said plane including the magnetic path of said magnetic circuit is substantially perpendicular to said plane.

3. An electromagnetic drive actuator as claimed in claim 1, wherein said yoke is L-shaped in cross section and has two inner walls, and said magnet is arranged on one of said inner walls of said yoke.

4. An electromagnetic drive actuator as claimed in claim 1, wherein said yoke is U-shaped in cross section and has three inner walls, and said magnet is mounted on at least one of said inner walls.

5. An electromagnetic drive actuator as claimed in claim 1, wherein said magnetic circuit includes one yoke and one magnet mounted on the inner surface thereof.

6. An electromagnetic drive actuator as claimed in claim 5, wherein said coil is arranged so as to confront said yoke.

7. An electromagnetic drive actuator as claimed in claim 5, wherein said coil is arranged so as to accommodate said yoke and said magnet therein.

8. An electromagnetic drive actuator as claimed in claim 1, wherein said magnetic circuit includes at least one plate-shaped yoke and at least two magnets mounted on one surface of said plate-shaped yoke, the magnetic flux extending from one of said two magnets entering the other magnet and returning through said yoke to said one yoke.

9. An electromagnetic drive actuator as claimed in claim 8, wherein said coil is arranged so as to confront said yoke.

10. An electromagnetic drive actuator as claimed in claim 9, wherein two coils are arranged in such a manner that each of said coils confronts each of said two magnets.

11. An electromagnetic drive actuator as claimed in claim 10, wherein said magnetic shield member are disposed so as to cover both neighboring side portions of said two coils.

12. An electromagnetic drive actuator as claimed in claim 8, wherein said direction crossing said plane including the magnetic path of said magnetic circuit is substantially perpendicular to said plane.

13. An electromagnetic drive actuator as claimed in claim 1, wherein said magnetic circuit includes an E-shaped yoke comprising a center yoke, two side yokes arranged so as to confront both side surfaces of said center yoke respectively, and an outer yoke connecting said center yoke and said side yokes, and wherein said magnet is arranged in at least one of air gaps defined by respective inner surfaces of said center, side and outer yokes.

14. An electromagnetic drive actuator as claimed in claim 13, wherein said coil is U-shaped in cross section, and is slidably engaged with said E-shaped yoke such that at least one of both side walls of said coil crosses the magnetic flux formed by said magnet.

15. An electromagnetic drive actuator as claimed in claim 13, wherein said direction crossing said plane including the magnetic path of said magnetic circuit is substantially perpendicular to said plane.

* * * * *